US009010000B1

(12) United States Patent
Rodriguez

(10) Patent No.: US 9,010,000 B1
(45) Date of Patent: Apr. 21, 2015

(54) CONVERTIBLE FLAG AND BANNER SYSTEM

(71) Applicant: Daniel C. Rodriguez, Hallandale Beach, FL (US)

(72) Inventor: Daniel C. Rodriguez, Hallandale Beach, FL (US)

( * ) Notice: Subject to any disclaimer, the term of this patent is extended or adjusted under 35 U.S.C. 154(b) by 0 days.

(21) Appl. No.: 14/583,500

(22) Filed: Dec. 26, 2014

Related U.S. Application Data

(63) Continuation-in-part of application No. 14/066,396, filed on Oct. 29, 2013, now abandoned.

(51) Int. Cl.
*G09F 17/00* (2006.01)
*G09F 21/04* (2006.01)
*G09F 7/00* (2006.01)

(52) U.S. Cl.
CPC ..... *G09F 17/00* (2013.01); *G09F 21/04* (2013.01); *G09F 7/002* (2013.01); *G09F 2017/0075* (2013.01); *G09F 2017/005* (2013.01)

(58) Field of Classification Search
CPC ..... G09F 15/025; G09F 2015/0093; G09F 17/00; G09F 2017/005
See application file for complete search history.

(56) References Cited

U.S. PATENT DOCUMENTS

| | | | | |
|---|---|---|---|---|
| 1,876,351 | A | | 9/1932 | Shirley |
| 2,534,117 | A | | 12/1950 | Flick |
| 3,119,370 | A | | 1/1964 | Keats |
| 3,127,868 | A | | 4/1964 | Guthrie |
| 3,136,289 | A | | 6/1964 | Johnson |
| 3,241,516 | A | | 3/1966 | Hopkins |
| 3,540,685 | A | | 11/1970 | Gualano |
| 3,715,821 | A | | 2/1973 | Hawes |
| 3,738,039 | A | | 6/1973 | De Furia |
| 3,762,360 | A | | 10/1973 | Hawes |
| D248,284 | S | | 6/1978 | Bowser |
| D313,214 | S | | 12/1990 | Phillips et al. |
| 5,042,418 | A | | 8/1991 | Hoover |
| 5,233,938 | A | | 8/1993 | Lalo |
| D343,690 | S | * | 1/1994 | Carey ..... D25/48.6 |
| 5,363,792 | A | * | 11/1994 | Petechik ..... 116/28 R |
| 5,463,974 | A | * | 11/1995 | Seeder ..... 116/173 |
| D421,238 | S | | 2/2000 | Dinsky |
| D438,820 | S | | 3/2001 | Goulding |
| 6,874,167 | B1 | | 4/2005 | Leszczynski |
| 7,063,096 | B2 | * | 6/2006 | Stoeckler ..... 135/114 |
| 7,234,411 | B1 | | 6/2007 | Butler |
| 7,878,139 | B1 | | 2/2011 | Karnes et al. |
| D657,712 | S | | 4/2012 | Bigbee |
| 2005/0204599 | A1 | | 9/2005 | Myles |
| 2009/0007473 | A1 | * | 1/2009 | Gimpel et al. ..... 40/604 |

* cited by examiner

*Primary Examiner* — Casandra Davis

(57) ABSTRACT

A flag and banner system for displaying a flag and/or a banner on a flat panel of a vehicle. The system features a first mast with two linear mast channels, a first indexing base with an attachment clip that attaches to an inner edge of a pivoting panel of the vehicle, and a first pliable flag. The system also features a second mast with two linear mast channels, a second indexing base with an attachment clip that attaches to the inner edge of the pivoting panel of the vehicle at an offset from the first indexing base, and a second pliable flag. The first pliable flag is connected to the first mast and the second pliable flag is connected to the second mast via attachment tabs. A banner is attached to both the first and second mast via attachment tabs.

13 Claims, 11 Drawing Sheets

CONVERTIBLE FLAG AND BANNER SYSTEM

CROSS REFERENCE

This application claims priority to U.S. patent application Ser. No. 14/066,396, filed Oct. 29, 2013, the specification(s) of which is/are incorporated herein in their entirety by reference.

FIELD OF THE INVENTION

The present invention relates to vehicle mounted flags and banners.

BACKGROUND OF THE INVENTION

There are numerous flags used to display team logos that are attachable to windows of vehicles, however, if a driver has the windows down, the flags cannot be used. The present invention features a flag and banner system for displaying a flag or a banner or both on a flat panel of a vehicle such as a trunk lid.

The system allows the driver to have his/her windows down and still show his/her team spirit. The flag and banner system of the present invention is not limited to displaying team logos. Other designs or logos may be displayed, including but not limited to a state flag, a country flag, a holiday design, a school logo, an organization's logo, a custom design, etc.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a flag and banner system for displaying a flag or a banner or both on a flat panel of a vehicle. In some embodiments, the system comprises a first mast having a mast top end, a mast bottom end, and a mast side wall, in some embodiments, a first linear mast channel is located in the mast side wall from the mast top end and extending toward but not reaching the mast bottom end. In some embodiments, a second linear mast channel is located in the mast side wall from the mast top end and extending toward but not reaching the mast bottom end. In some embodiments, the second mast channel is perpendicular to the first mast channel.

In some embodiments, the system comprises a first indexing base having a base top surface and a base bottom surface. In some embodiments, an attachment clip is located on the base bottom surface thereon. In some embodiments, the attachment clip attaches to an inner edge of a pivoting panel of the vehicle upon opening the pivoting panel. In some embodiments, an indexing mount is located on the base top surface thereon. In some embodiments, the indexing mount adjustably attaches to the mast bottom end via a fastener perpendicularly located there through. In some embodiments, the indexing mount allows the mast to pivot in at least a first direction and an opposing second direction with respect to the attachment clip. In some embodiments, the mast can be secured in a particular position via the fastener.

In some embodiments, the system comprises a first pliable flag having a proximal flag edge and an opposing distal flag edge. In some embodiments, a rigid mast attachment tab is located on the proximal flag edge. In some embodiments, the mast attachment tab slides through a mast channel aperture located on a mast top end into the mast channel. In some embodiments, the system comprises a second mast, a second indexing base, and a second pliable flag. In some embodiments, the system further comprises a banner.

DESCRIPTION OF PREFERRED EMBODIMENTS

Figure 1:
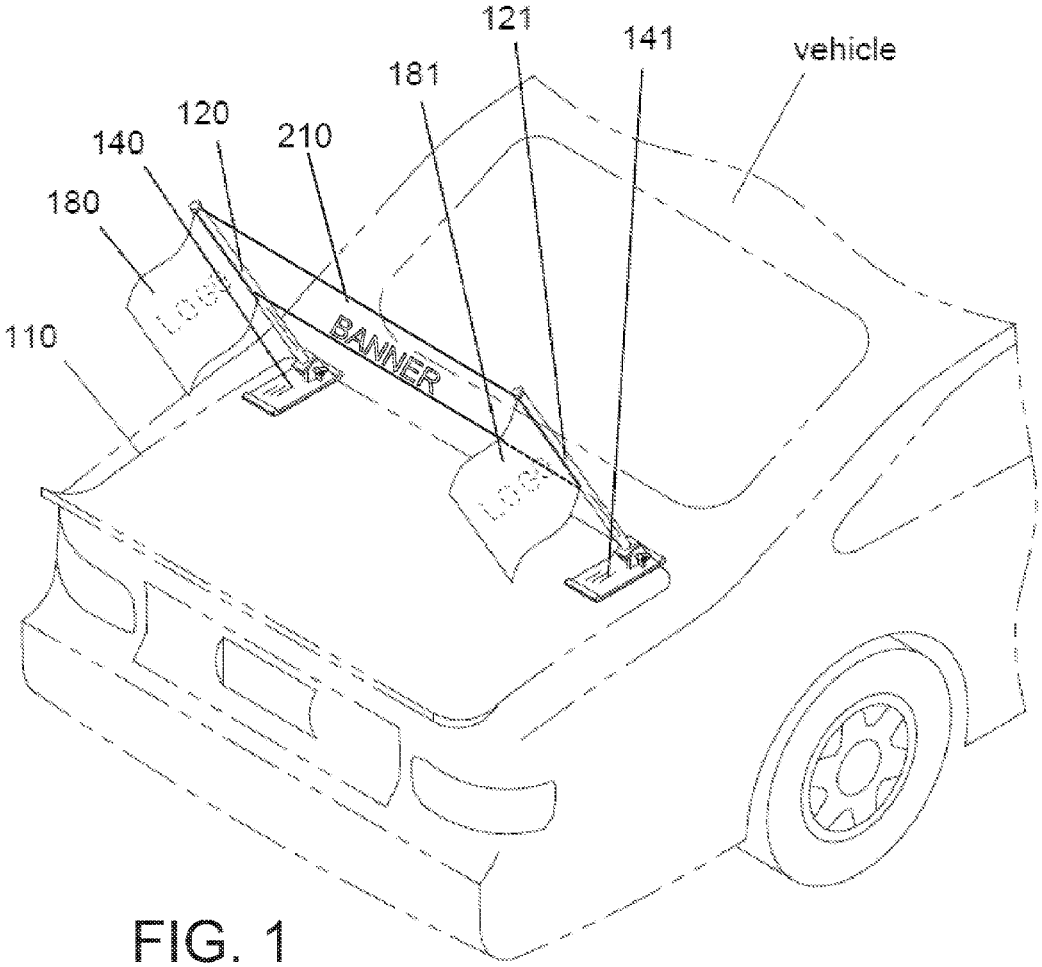
FIG. 1 shows a perspective view of the first mast, the first indexing base, and the first pliable flag attached to a pivoting panel of a vehicle; the second mast, the second indexing base, and the second pliable flag attached to a pivoting panel of a vehicle; and the pliable banner attached to the first and second mast of the preferred embodiment of the present invention.

Following is a list of elements corresponding to a particular element referred to herein:

100 Convertible flag and banner system
110 Pivoting panel
112 Inner edge
120 First mast
121 Second mast
122 Mast top end
124 Mast bottom end
126 Mast side wall
**130*a*** First mast channel
**130*b*** Second mast channel

Figure 2:
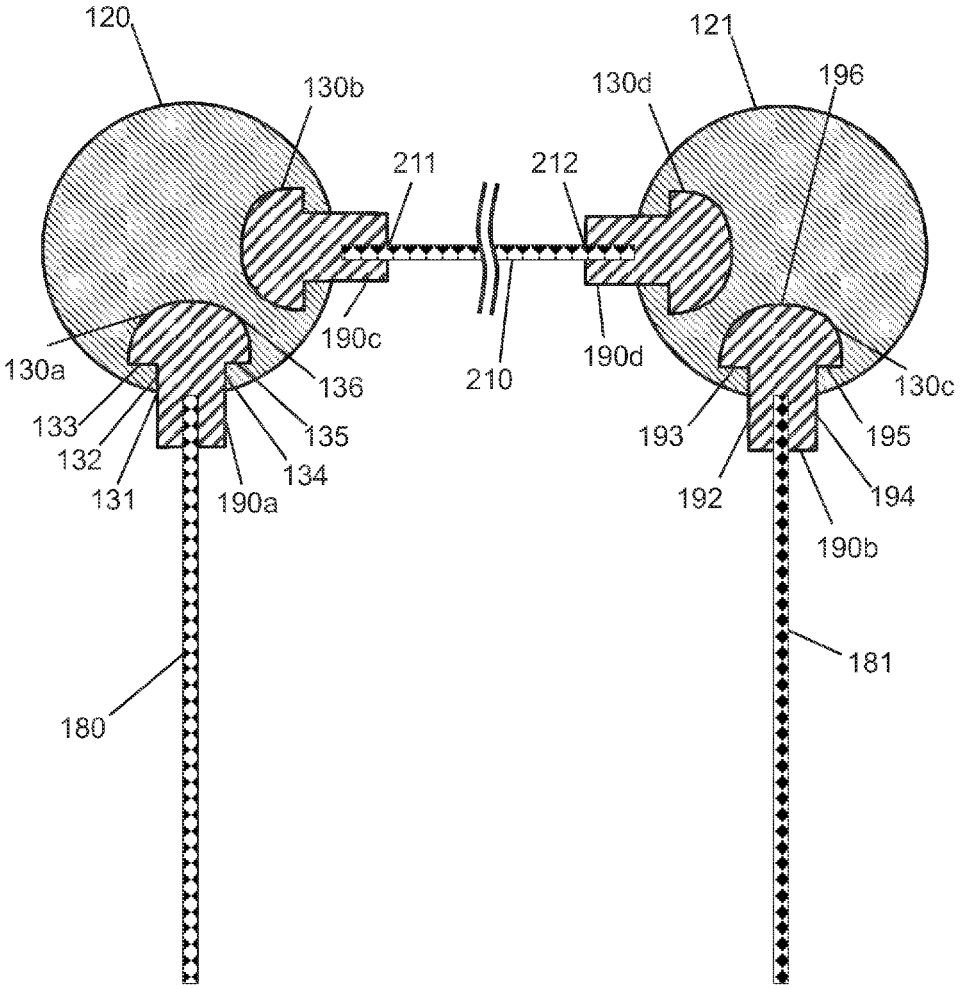
FIG. 2 shows a cross-sectional view of the first mast and second masts of a preferred embodiment of the present invention.
Figure 3:
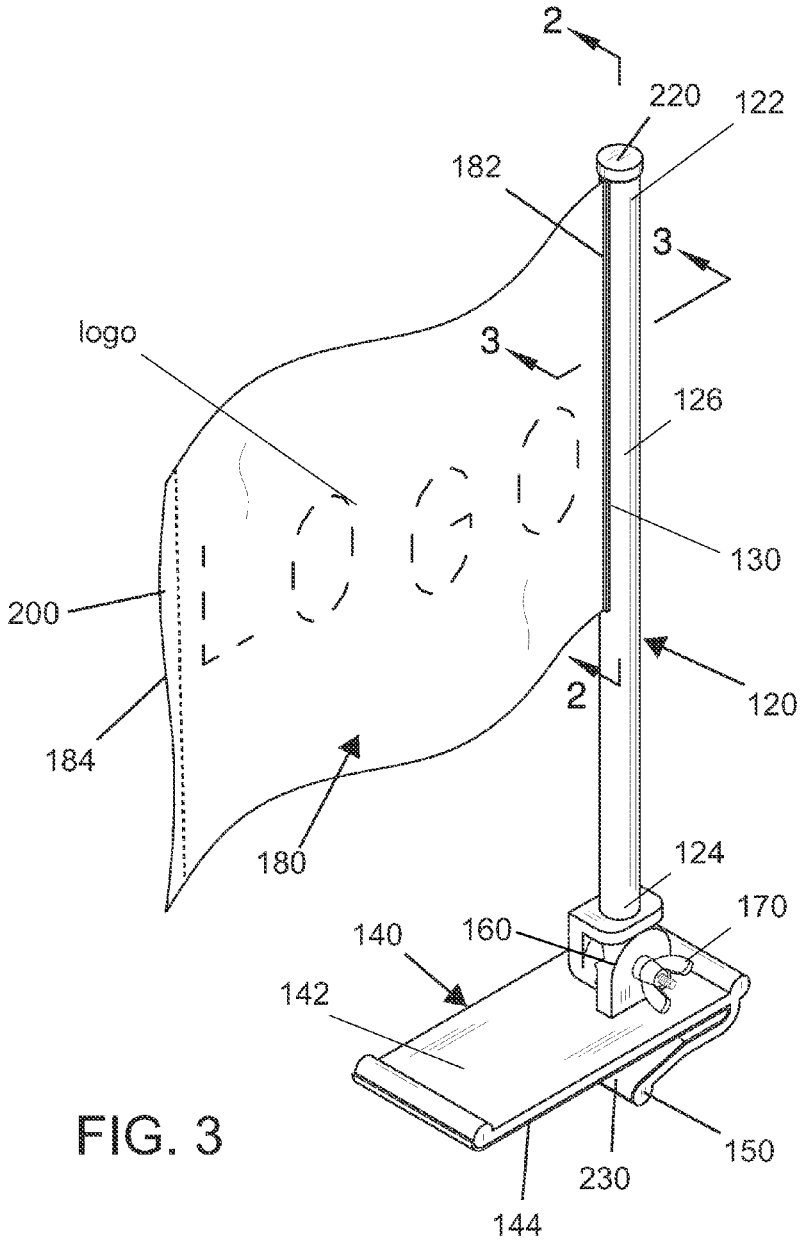
FIG. 3 shows a perspective view of the first mast, the first indexing base, and the first pliable flag of the present invention.
Figure 4:
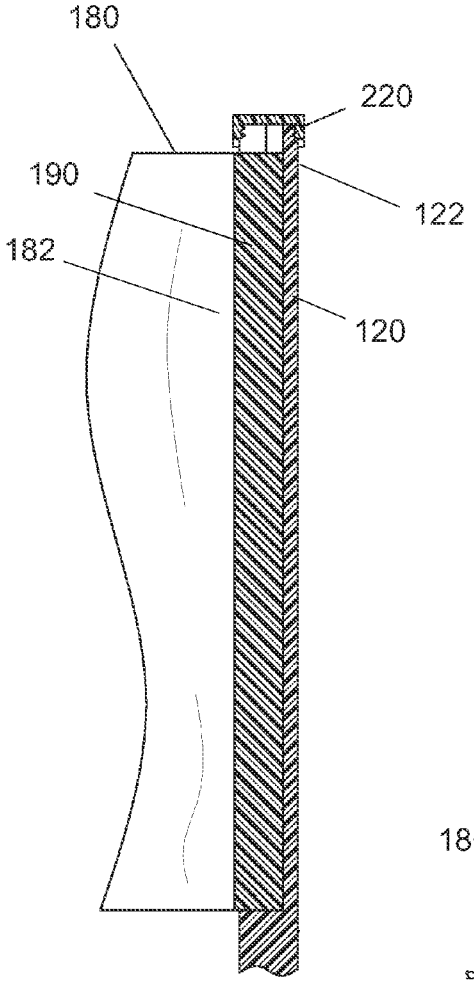
FIG. 4 shows a cross-sectional view of the first mast of the present invention.
Figure 5:
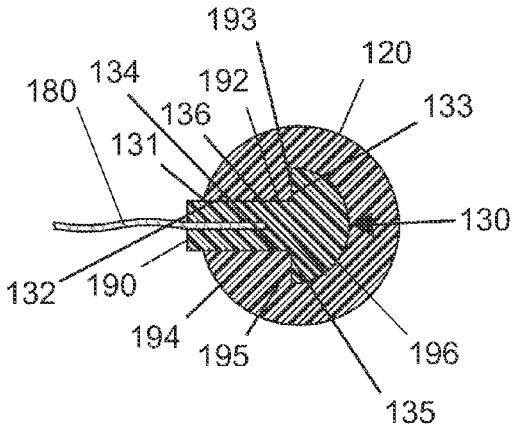
FIG. 5 shows a cross-sectional view of the first mast of an alternative embodiment of the present invention.
Figure 6:
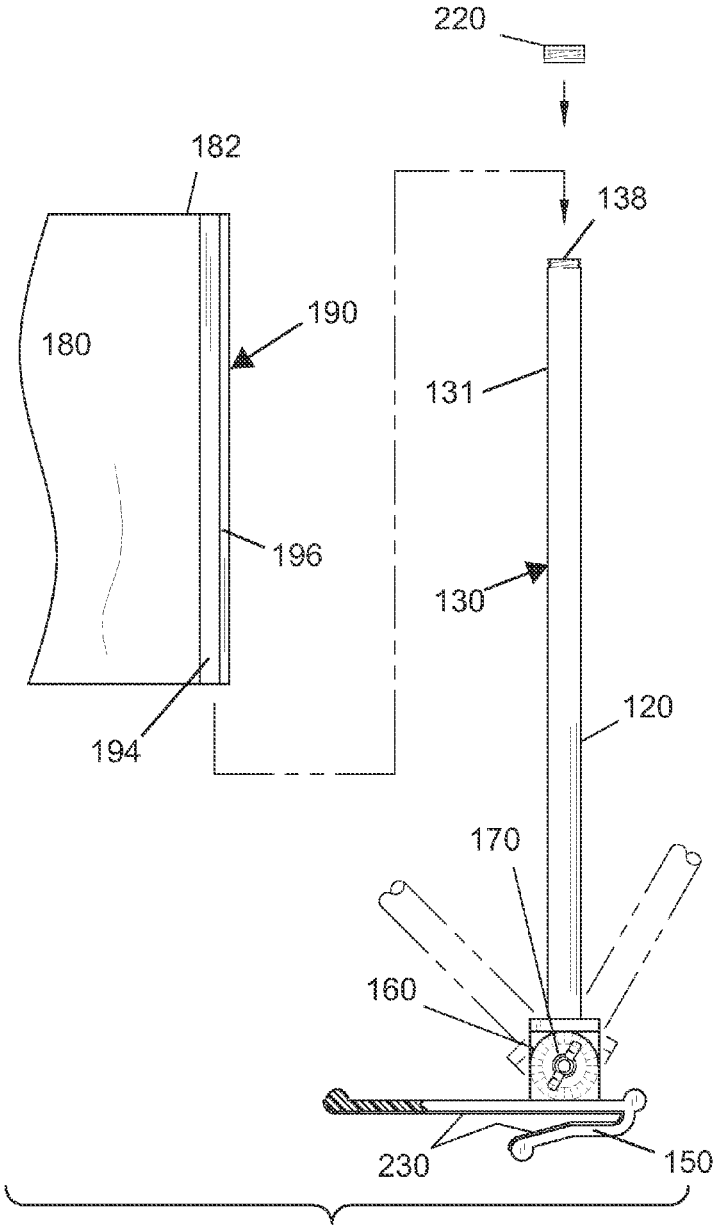
FIG. 6 shows a side view of the first mast, the first indexing base, and the first pliable flag of the present invention featuring the attachment of the first pliable flag to the first mast.
Figure 7:
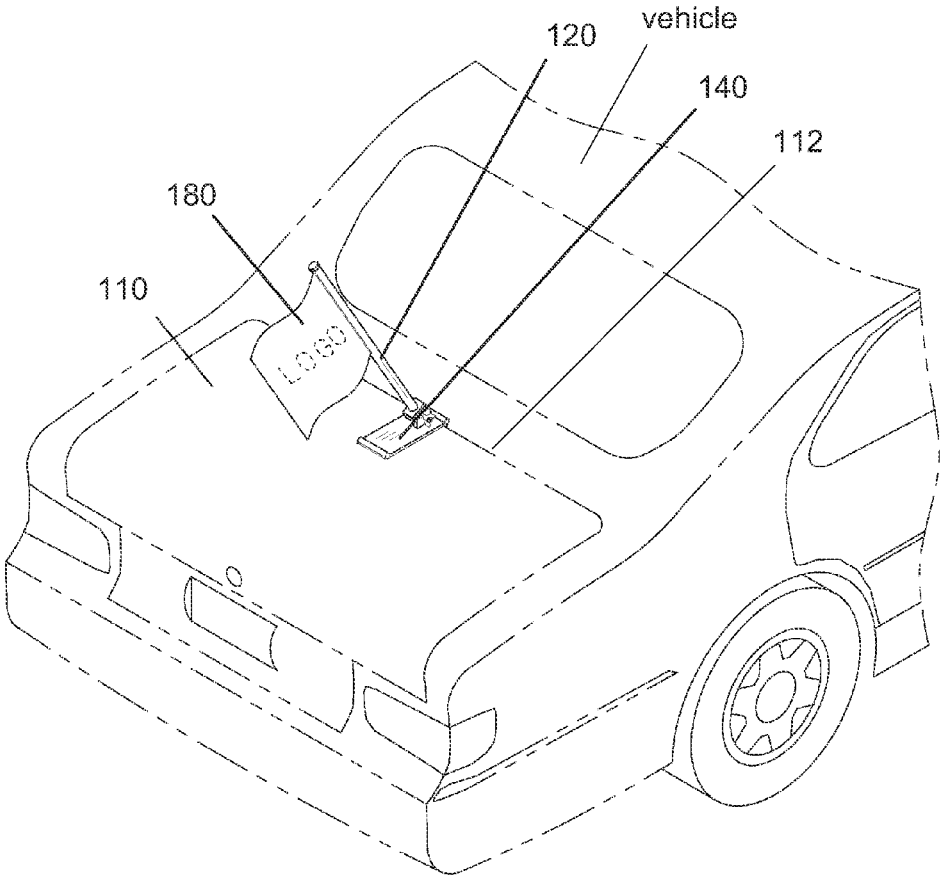
FIG. 7 shows a perspective view of the first mast, the first indexing base, and the first pliable flag attached to a pivoting panel of a vehicle.
Figure 8:
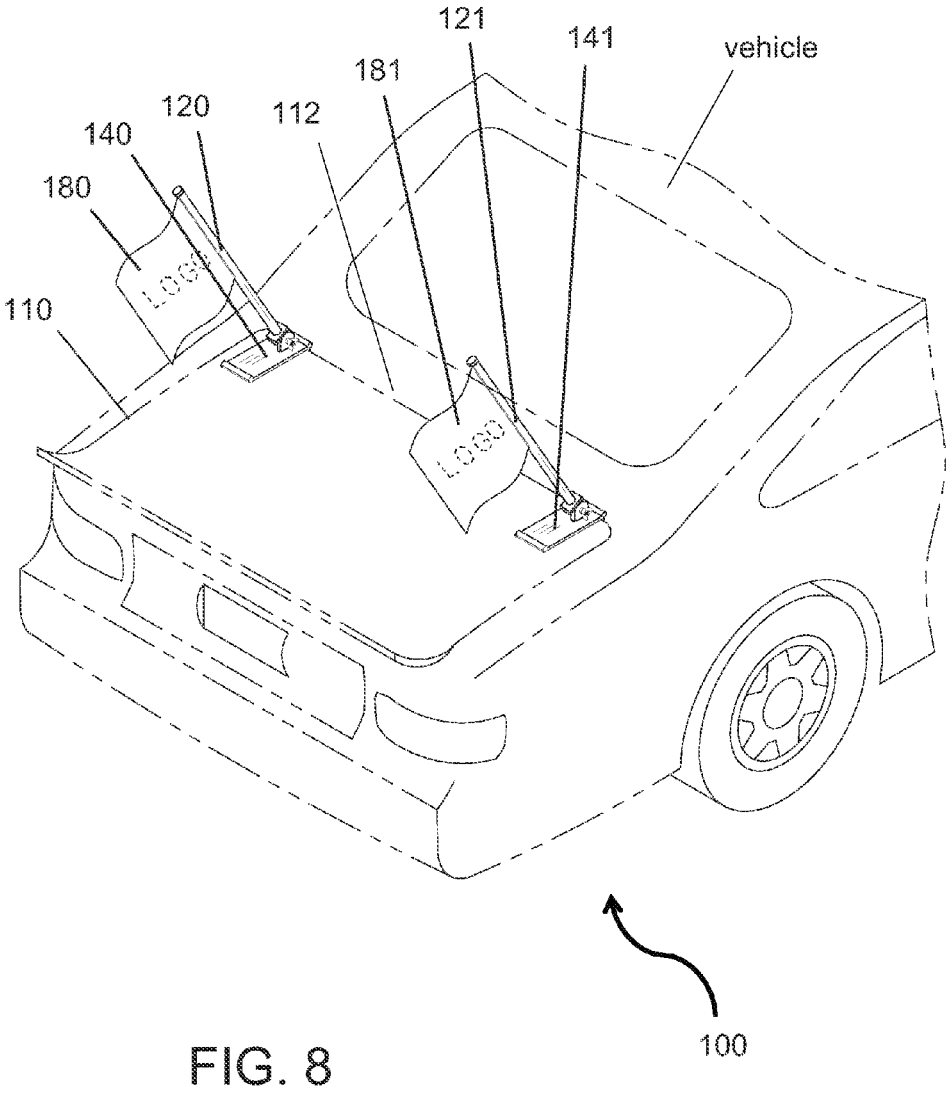
FIG. 8 shows a perspective view of the first mast, the first indexing base, and the first pliable flag attached to a pivoting panel of a vehicle, also the second mast, the second indexing base, and the second pliable flag attached to a pivoting panel of a vehicle.
Figure 9:
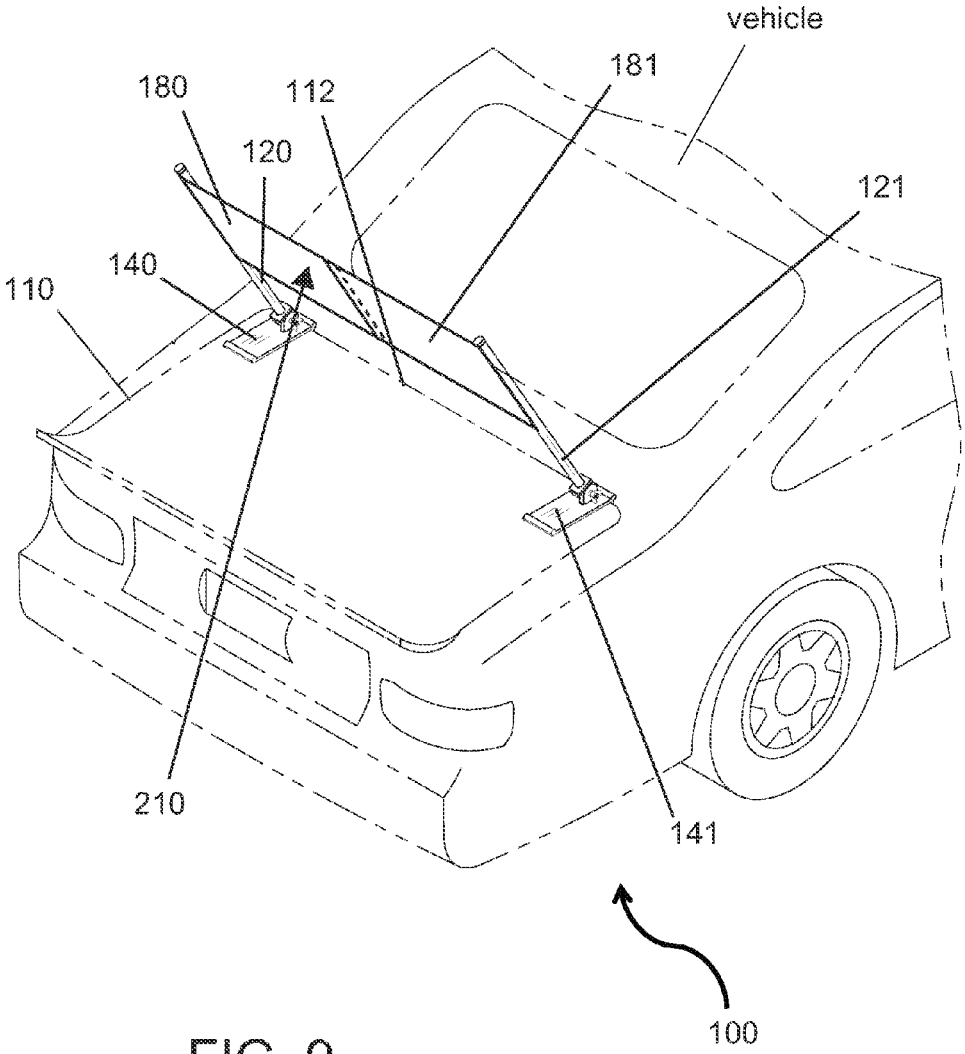
FIG. 9 shows a perspective view of an alternative embodiment of the present invention.
Figure 10:
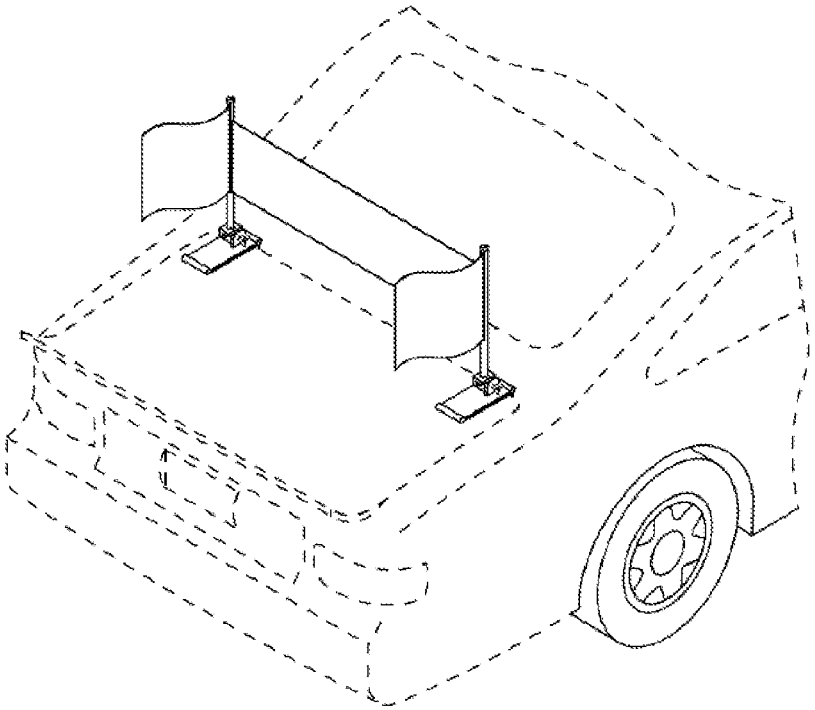
FIG. 10 shows a perspective view of an alternative embodiment of the present invention.
Figure 11:
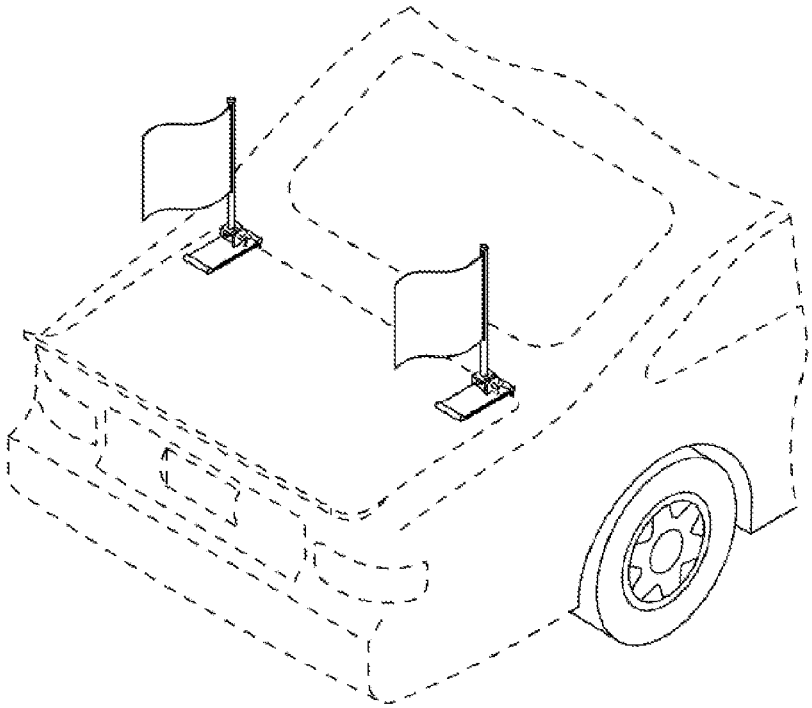
FIG. 11 shows a perspective view of an alternative embodiment of the present invention.
Figure 12:
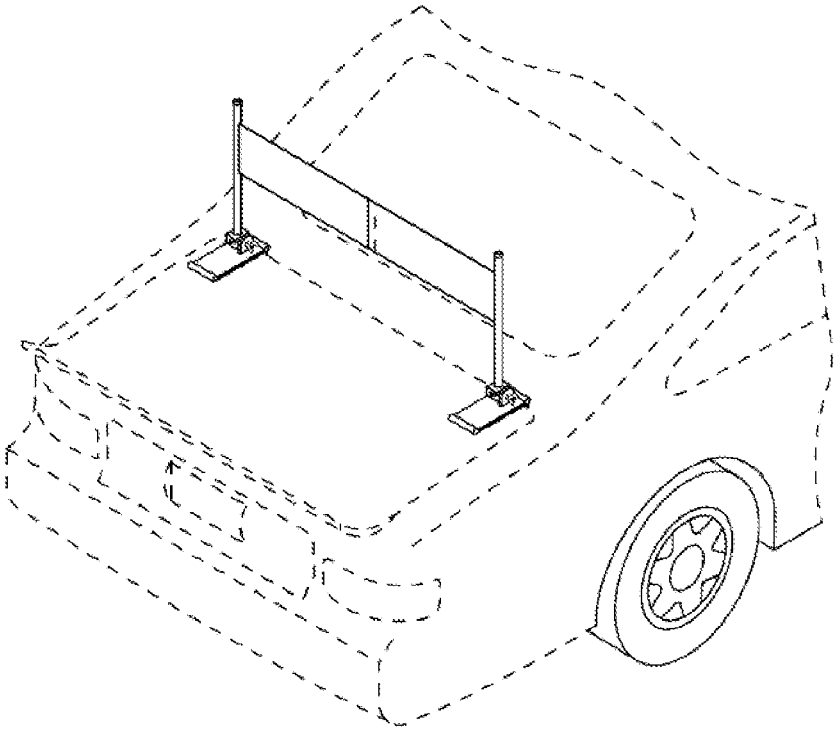
FIG. 12 shows a perspective view of an alternative embodiment of the present invention.
Figure 13:
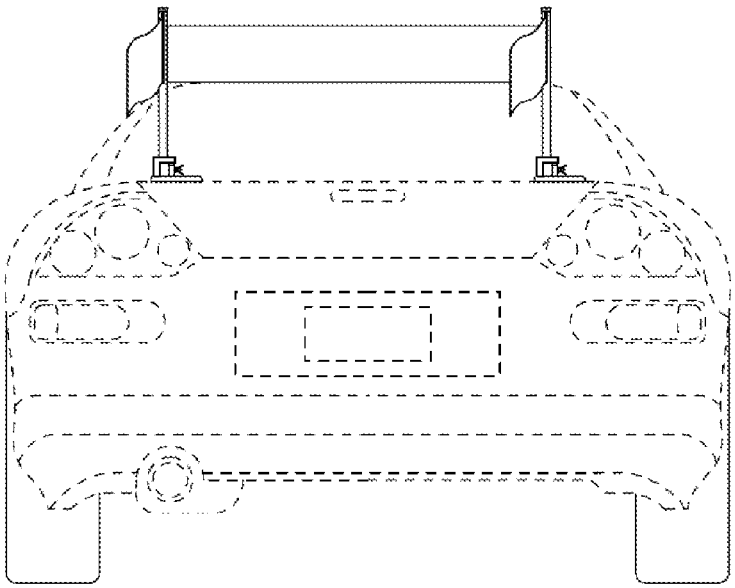
FIG. 13 shows an alternative embodiment of the present invention.
Figure 14:
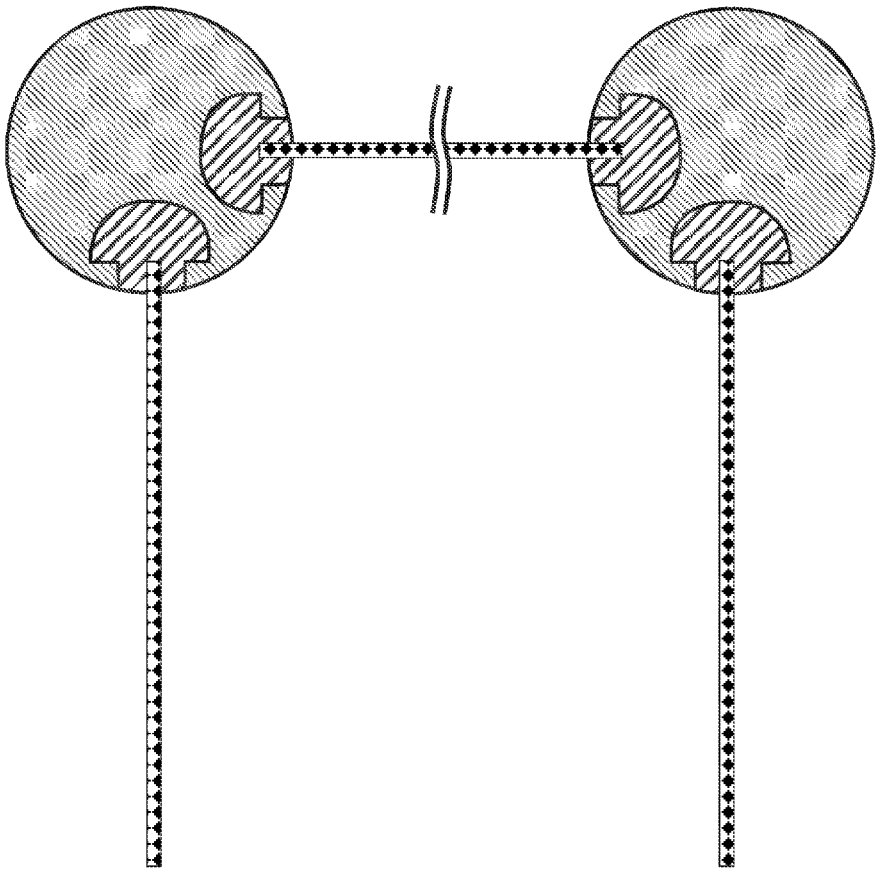
FIG. 14 shows an alternative embodiment of the present invention.

130*c* Third mast channel
130*d* Fourth mast channel
131 Channel opening
132 First channel side wall
133 First internal ledge
134 Second channel side wall
135 Second internal ledge
136 Channel back wall
138 Mast channel aperture
140 First indexing base
141 Second indexing base
142 Base top surface
144 Base bottom surface
150 Attachment clip
160 Indexing mount
170 Fastener
180 First pliable flag
181 Second pliable flag
182 Proximal flag edge
184 Distal flag edge
190*a* First mast attachment tab
190*b* Second mast attachment tab
190*c* Third mast attachment tab
190*d* Fourth mast attachment tab
192 First mast attachment tab side wall
193 First external ledge
194 Second mast attachment tab side wall
195 Second external ledge
196 Mast attachment tab projection
200 Flag connecting means
210 Banner
211 Banner first end
212 Banner second end
220 Cap
230 Pad Referring now to FIGS. 1-14, the present invention features a convertible flag and banner system (100) for displaying a flag or a banner (210) on a flat panel of a vehicle. In some embodiments, the system (100) comprises a first mast (120) having a mast top end (122), a mast bottom end (124), and a mast side wall (126).

In some embodiments, a first linear mast channel (130*a*) is located in the mast side wall (126) of the first mast (120) from the mast top end (122) and extending toward but not reaching the mast bottom end (124). In some embodiments, the first mast channel (130*a*) comprises a channel opening (131), a first channel side wall (132) having a first internal ledge (133) located thereon, an opposing second channel side wall (134) having a second internal ledge (135) located thereon, and a semicircular channel back wall (136) connecting the first internal ledge (133) and the second internal ledge (135).

In some embodiments, a second linear mast channel (130*b*) is located in the mast side wall (126) of the first mast (120) from the mast top end (122) and extending toward but not reaching the mast bottom end (124). In some embodiments, the second mast channel (130*b*) is perpendicular to the first mast channel (130*a*). In some embodiments, the second mast channel (130*b*) comprises a channel opening (131), a first channel side wall (132) having a first internal ledge (133) located thereon, an opposing second channel side wall (134) having a second internal ledge (135) located thereon, and a semicircular channel back wall (136) connecting the first internal ledge (133) and the second internal ledge (135).

In some embodiments, the system (100) comprises a first indexing base (140) having a base top surface (142) and a base bottom surface (144).

In some embodiments, an attachment clip (150) is located on the base bottom surface (144) thereon. In some embodiments, the attachment clip (150) slidably attaches to an inner edge (112) of a pivoting panel (110) of the vehicle upon opening the pivoting panel (110).

In some embodiments, an indexing mount (160) is located on the base top surface (142) thereon. In some embodiments, the indexing mount (160) adjustably attaches to the mast bottom end (124) via a fastener (170) perpendicularly located there through. In some embodiments, the indexing mount (160) allows the first mast (120) to pivot in at least a first direction and an opposing second direction with respect to the attachment clip (150). In some embodiments, the first mast (120) can be secured in a particular position via the fastener (170). In some embodiments, the first mast (120) can be set at an angle between 0 and 90 degrees with respect to the attachment clip (150).

In some embodiments, the system (100) comprises a first pliable flag (180) having a proximal flag edge (182) and an opposing distal flag edge (184). In some embodiments, a first rigid mast attachment tab (190*a*) is located on the proximal flag edge (182). In some embodiments, the first mast attachment tab (190*a*) matedly slides through a mast channel aperture (138) located on the mast top end (122) into the first mast channel (130*a*). In some embodiments, the first mast attachment tab (190*a*) comprises a first mast attachment tab side wall (192) having a first external ledge (193) located thereon, an opposing second mast attachment tab side wall (194) having a second external ledge (195) located thereon, and a semicircular mast attachment tab projection (196) connecting the first external ledge (193) and the second external ledge (195).

In some embodiments, the system (100) comprises a second mast (121) having a mast top end (122), a mast bottom end (124), and a mast side wall (126). In some embodiments, a third linear mast channel (130*c*) is located in the mast side wall (126) of the second mast (121) from the mast top end (122) and extending toward but not reaching the mast bottom end (124). In some embodiments, the third mast channel (130*c*) comprises a channel opening (131), a first channel side wall (132) having a first internal ledge (133) located thereon, an opposing second channel side wall (134) having a second internal ledge (135) located thereon, and a semicircular channel back wall (136) connecting the first internal ledge (133) and the second internal ledge (135).

In some embodiments, a fourth linear mast channel (130*d*) is located in the mast side wall (126) of the second mast (121) from the mast top end (122) and extending toward but not reaching the mast bottom end (124). In some embodiments, the fourth mast channel (130*d*) is perpendicular to the third mast channel (130*c*). In some embodiments, the fourth mast channel (130*d*) comprises a channel opening (131), a first channel side wall (132) having a first internal ledge (133) located thereon, an opposing second channel side wall (134) having a second internal ledge (135) located thereon, and a semicircular channel back wall (136) connecting the first internal ledge (133) and the second internal ledge (135).

In some embodiments, the system (100) comprises a second indexing base (141) having a base top surface (142) and a base bottom surface (144). In some embodiments, an attachment clip (150) is located on the base bottom surface (144) thereon. In some embodiments, the attachment clip (150) slidably attaches to the inner edge (112) of the pivoting panel (110) of the vehicle upon opening the pivoting panel (110), at an offset from the first indexing base (140).

In some embodiments, an indexing mount (160) is located on the base top surface (142) thereon. In some embodiments, the indexing mount (160) adjustably attaches to the mast bottom end (124) via a fastener (170) perpendicularly located there through. In some embodiments, the indexing mount (160) allows the second mast (121) to pivot in at least a first direction and an opposing second direction with respect to the attachment clip (150). In some embodiments, the second mast (121) can be secured in a particular position via the fastener (170). In some embodiments, the second mast (121) can be set at an angle between 0 and 90 degrees with respect to the attachment clip (150).

In some embodiments, the system (100) comprises a second pliable flag (181) having a proximal flag edge (182) and an opposing distal flag edge (184). In some embodiments, a second rigid mast attachment tab (190*b*) is located on the proximal flag edge (182). In some embodiments, the second mast attachment tab (190*d*) matedly slides through a mast channel aperture (138) located on the mast top end (122) into the third mast channel (130*c*). In some embodiments, the second mast attachment tab (190*b*) comprises a first mast attachment tab side wall (192) having a first external ledge (193) located thereon, an opposing second mast attachment tab side wall (194) having a second external ledge (195) located thereon, and a semicircular mast attachment tab projection (196) connecting the first external ledge (193) and the second external ledge (195).

In some embodiments, the system (100) comprises a pliable banner (210) having a first banner end (211) and an opposing second banner end (212). In some embodiments, a third rigid mast attachment tab (190*c*) is disposed on the first banner end (211). In some embodiments, the third mast attachment tab (190*c*) matedly slides through a mast channel aperture (138) disposed on the mast top end (122) into the second mast channel (130*b*) of the first mast (120). In some embodiments, a fourth rigid mast attachment tab (190*d*) is disposed on the second banner end (212). In some embodiments, the fourth mast attachment tab (190*d*) matedly slides through a mast channel aperture (138) disposed on the mast top end (122) into the fourth mast channel (130)d of the second mast (121). In some embodiments, the banner (210) spans at least a portion of the pivoting panel (110) of the vehicle. In some embodiments, each mast attachment tab (190) comprises a first mast attachment tab side wall (192) having a first external ledge (193) disposed thereon, an opposing second mast attachment tab side wall (194) having a second external ledge (195) disposed thereon, and a semicircular mast attachment tab projection (196) connecting the first external ledge (193) and the second external ledge (195).

In some embodiments, the first pliable flag (180), the second pliable flag (181), the pliable banner (210), or a combination thereof is displayed on the flat panel of the vehicle. In preferred embodiments, the first pliable flag (180), the second pliable flag (181), and the pliable banner (210) are displayed on the flat panel of the vehicle. This allows for a person to see any logos on the flags when viewed from the side of a vehicle, as well as any logos on the banner when viewed from the back of the vehicle. This flag and banner display system prominently displays the logos by allowing the system to be viewed from various angles.

In some embodiments, the pivoting panel (110) is a hood of a vehicle. In some embodiments, the pivoting panel (110) is a trunk lid of a vehicle. In some embodiments, the pivoting panel (110) is a door of a vehicle. In some embodiments, the pivoting panel (110) is a bed cover of a vehicle. In some embodiments, the pivoting panel (110) is a moon roof or a sun roof of a vehicle.

In some embodiments, the first mast (120) or the second mast (121) is linear. In some embodiments, the first mast (120) or the second mast (121) comprises an angle located therein between the mast top end (122) and the mast bottom end (124). In some embodiments, the first mast (120) or the second mast (121) comprises a curve located therein between the mast top end (122) and the mast bottom end (124).

In some embodiments, the first mast (120) or the second mast (121) is rotatable at the first indexing base (140) or the second indexing base (141). In some embodiments, the first mast (120) or the second mast (121) pivots in at least a first direction and an opposing second direction and rotates in at least a first direction and an opposing second direction.

In some embodiments, the first pliable flag (180), the second pliable flag (181), or the pliable banner (210). In some embodiments, the first pliable flag (180), the second pliable flag (181), or the pliable banner (210) allows air to pass there through.

In some embodiments, a logo is located on a surface of the first pliable flag (180), the second pliable flag (181), or the pliable banner (210). In some embodiments, the logo comprises a sports team logo, a sports team symbol, a state symbol, a country flag, a holiday design, a school logo, an organization's logo, or a custom design.

In some embodiments, the system (100) comprises a cap (220) removably attached to the mast top end (122) so as to prevent the mast attachment tab (190) from slipping out of the mast channel (130) via the mast top aperture.

In some embodiments, the system (100) comprises a pad (230) located on a surface of the attachment clip (150) that comes in contact with the pivoting panel (110) of the vehicle to prevent the attachment clip (150) from scratching the pivoting panel (110) of the vehicle.

In some embodiments, the first indexing base (140) is located at a base distance from the second indexing base (141) to set the span that the banner (210) must cover. In some embodiments, the banner is tensioned via locating the first indexing vase (140) or the second indexing base (141).

In some embodiments, the system (100) can be used on a top pivoting panel of the vehicle, for example a vehicle with a horizontal surface. In some embodiments, the system (100) can be used on a side pivoting panel of the vehicle, for example a vehicle with a vertical surface.

Alternative Embodiments

In alternative embodiments, a flag connecting means (200) is located on the distal flag edge (184). In some embodiments, the flag connecting means (200) of the first pliable flag (180) is attached to the flag connecting means (200) of the second pliable flag (181) forming a banner (210). In some embodiments, the convertible flag and banner system (100) converts from displaying two independent flags on the first mast (120) and the second mast (121) to displaying a single banner (210) between the first mast (120) and the second mast (121), In some embodiments, the flag connecting means (200) is a component of a plastic zipper system. In some embodiments, the flag connecting means (200) of the first pliable flag (180) attachably connects to the flag connecting means (200) of the second pliable flag (181) forming the banner (210). In another alternative embodiment, the flag connecting means (200) is a component of a hook and loop system. In some embodiments, the flag connecting means (200) of the first pliable flag (180) attachably connects to the flag connecting means (200) of the second pliable flag (181) forming the banner (210). In some embodiments, the flag connecting means (200) is a component of a snap system. In some embodiments, the flag connecting means (200) of the first pliable flag (180) attachably connects to the flag connecting means (200) of the second pliable flag (181) forming the banner (210). In some embodiments, the flag connecting means (200) is a component of a button system. In some embodiments, the flag connecting means (200) of the first pliable flag (180) attachably connects to the flag connecting means (200) of the second pliable flag (181) forming the banner (210). In some embodiments, the flag connecting means (200) is an adhesive. In some embodiments, the flag connecting means (200) of the first pliable flag (180) attachably connects to the flag connecting means (200) of the second pliable flag (181) forming the banner (210).

The disclosures of the following U.S. patents are incorporated in their entirety by reference herein: U.S. Pat. No. 1,876,351; U.S. Pat. No. 3,127,868; U.S. Pat. No. 3,241,516; U.S. Pat. No. 5,233,938; U.S. Pat. No. 5,463,974; U.S. Pat. No. 7,878,139; U.S. Design Pat. No. D 313,214; U.S. Design Pat. No. D 421,238; and U.S. Design Pat. No. D 657,712.

As used herein, the term "about" refers to plus or minus 10% of the referenced number. Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A flag and banner system (100) for displaying a flag or a banner (210) or both on a panel of a vehicle, wherein the system (100) comprises:

(a) a first mast (120) having a mast top end (122), a mast bottom end (124), and a mast side wall (126), wherein a linear first mast channel (130*a*) is disposed in the mast side wall (126) from the mast top end (122) and extending toward but not reaching the mast bottom end (124), wherein the first mast channel (130*a*) comprises a channel opening (131), a first channel side wall (132) having a first internal ledge (133) disposed thereon, an opposing second channel side wall (134) having a second internal ledge (135) disposed thereon, and a semicircular channel back wall (136) connecting the first internal ledge (133) and the second internal ledge (135)

wherein a linear second mast channel (130*b*) is disposed in the mast side wall (126) from the mast top end (122) and extending toward but not reaching the mast bottom end (124), wherein the second mast channel (130*b*) is perpendicular to the first mast channel (130*a*), wherein the second mast channel (130*b*) comprises a channel opening (131), a first channel side wall (132) having a first internal ledge (t33) disposed thereon, an opposing second channel side wall (134) having a second internal ledge (135) disposed thereon, and a semicircular channel back wall (136) connecting the first internal ledge (133) and the second internal ledge (135);

(b) a first indexing base (140) having a base top surface (142) and a base bottom surface (144), wherein an attachment clip (150) is disposed on the base bottom surface (144) thereon, wherein the attachment clip (150) slidably attaches to an inner edge (112) of a pivoting panel (110) of the vehicle upon opening the pivoting panel (110), wherein an indexing mount (160) is disposed on the base top surface (142) thereon, wherein the indexing mount (160) adjustably attaches to the mast bottom end (124) via a fastener (170) perpendicularly disposed there through, wherein the indexing mount (160) allows the first mast (120) to pivot in at least a first direction and an opposing second direction with respect to the attachment clip (150), wherein the first mast (120) can be secured in a particular position via the fastener (170);

(c) a first pliable flag (180) having a proximal flag edge (182) and an opposing distal flag edge (184), wherein a first rigid mast attachment tab (190*a*) is disposed on the proximal flag edge (182), wherein the first mast attachment tab (190*a*) matedly slides through a mast channel aperture (138) disposed on the mast fop end (122) into the first mast channel (130), (d) a second mast (121) having a mast top end (122), a mast bottom end (124), and a mast side wall (126), wherein a third linear mast channel (130*c*) is disposed in the mast side wall (126) from the mast top end (122) and extending toward but not reaching the mast bottom end (124), wherein the third mast channel (130*c*) comprises a channel opening (131), a first channel side wall (132) having a first internal ledge (133) disposed thereon, an opposing second channel side wall (134) having a second internal ledge (135) disposed thereon, and a semicircular channel back wall (136) connecting the first internal ledge (133) and the second internal ledge (135), wherein a fourth linear mast channel (130*d*) is disposed in the mast side wall (126) from the mast top end (122) and extending toward but not reaching the mast bottom end (124), wherein the fourth mast channel (130*d*} is perpendicular to the third mast channel (130), wherein the fourth mast channel (130*d*) comprises a channel opening (131), a first channel side wall (132) having a first internal ledge (133) disposed thereon, an opposing second channel side wall (134) having a second internal ledge (135} disposed thereon, and a semicircular channel back wall (136) connecting the first internal ledge (133) and the second internal ledge (135);

(e) a second indexing base (141) having a base top surface (142) and a base bottom surface (144), wherein an attachment clip (150) is disposed on the base bottom surface (144) thereon, wherein the attachment clip (150) slidably attaches to the inner edge (112) of the pivoting panel (110) of the vehicle upon opening the pivoting panel (110), at an offset from the first indexing base (140), wherein an indexing mount (160) is disposed on the base top surface (142) thereon, wherein the indexing mount (160) adjustably attaches to the mast bottom end (124) via a fastener (170) perpendicularly disposed there through, wherein the indexing mount (160) allows the second mast (121) to pivot in at least a first direction and an opposing second direction with respect to the attachment clip (150), wherein the second mast (121) can be secured in a particular position via the fastener (170);

(f) a second pliable flag (181) having a proximal flag edge (182) and an opposing distal flag edge (184), wherein a second rigid mast attachment tab (190*b*) is disposed on the proximal flag edge (182), wherein the second mast attachment tab (190*b*) matedly slides through a mast channel aperture (138) disposed on the mast top end (122) into the third mast channel (130*c*); and (g) a pliable banner (210) having a first banner end (211) and an opposing second banner end (212), wherein a third rigid mast attachment tab (190*c*) is disposed on the first banner end (211), wherein the third mast attachment tab (190*c*) matedly slides through a mast channel aperture (138) disposed on the mast top end (122) into the second mast channel (130*b*) of the first mast (120), wherein a fourth rigid mast attachment tab (190*d*) is disposed on the second banner end (212), wherein the fourth mast attachment tab (190*d*) matedly slides through a mast channel aperture (138) disposed on the mast top end (122) into the fourth mast channel (130*d*) of the second mast (121), wherein the banner (210) spans at least a portion of the pivoting panel (110) of the vehicle;

wherein each mast attachment tab (190*a-d*) comprises a first mast attachment tab side wall (192) having a first external ledge (193) disposed thereon, an opposing second mast attachment tab side wall (194) having a second external ledge (195) disposed thereon, and a semicircular mast attachment tab projection (196) connecting the first external ledge (193) and the second external ledge (195).

2. The system (100) of claim 1, wherein the pivoting panel (110) is a hood.

3. The system (100) of claim 1, wherein the pivoting panel (110) is a trunk lid.

4. The system (100) of claim 1, wherein the pivoting panel (110) is a door.

5. The system (100) of claim 1, wherein the pivoting panel (110) is a bed cover.

6. The system (100) of claim 1, wherein the pivoting panel (110) is a moon roof OF a sun roof.

7. The system (100) of claim 1, wherein the first mast (120) or the second mast (121) is linear.

8. The system (100) of claim 1, wherein the first pliable flag (180), the second pliable flag (181), or the pliable banner (210) is perforated to allow air to pass there through.

9. The system (100) of claim 1, wherein a logo is disposed on a surface of the first pliable flag (180), the second pliable flag (181), or the pliable banner (210).

10. The system (100) of claim 9, wherein the logo comprises a sports team logo, a sports team symbol, a state symbol, a country flag, a holiday design, a school logo, an organization's logo, or a custom design.

11. The system (100) of claim 1, further comprising a cap (220) removably attached to each mast top end (122) so as to prevent each mast attachment tabs (190) from slipping out of the mast channel (130) via the mast top aperture.

12. The system (100) of claim 1 further comprising a pad (230) disposed on a surface of the attachment clip (150) that comes in contact with the pivoting panel (110) of the vehicle to prevent the attachment clip (150) from scratching the pivoting panel (110) of the vehicle.

13. A flag and banner system (100) for displaying a flag or a banner (210) or both on a panel of a vehicle, wherein the system (100) comprises:

(a) a first mast (120) having a mast top end (122), a mast bottom end (124), and a mast side wall (126), wherein a linear first mast channel (130*a*) is disposed in the mast side wall (126) from the mast top end (122) and extending toward the mast bottom end (124), wherein the first mast channel (130*a*) comprises a channel opening (131), wherein a linear second mast channel (130*b*) is disposed in the mast side wall (126) from the mast top end (122) and extending toward the mast bottom end (124), wherein the second mast channel (130*b*) comprises a channel opening (131), (b) a first indexing base (140) having a base top surface (142) and a base bottom surface (144), wherein an attachment clip (150) is disposed on the base bottom surface (144) thereon, wherein the attachment clip (150) slidably attaches to an inner edge (112) of the panel (110) of the vehicle, wherein an indexing mount (160) is disposed on the base top surface (142) thereon, wherein the indexing mount (160) adjustably attaches to the mast bottom end (124) via a fastener (170) disposed there through, wherein the indexing mount (160) allows the first mast (120) to pivot in at least a first direction and an opposing second direction with respect to the attachment clip (150), wherein the first mast (120) can be secured in a particular position via the fastener (170);

(c) a first pliable flag (180) having a proximal flag edge (182) and an opposing distal flag edge (184), wherein a first rigid mast attachment tab (190*a*) is disposed on the proximal flag edge (182), wherein the first mast attachment tab (190*a*) matedly slides through a mast channel aperture (138) disposed on the mast top end (122) into the first mast channel (130), (d) a second mast (121) having a mast top end (122), a mast bottom end (124), and a mast side wall (126), wherein a third linear mast channel (130*c*) is disposed in the mast side wall (126) from the mast top end (122) and extending toward the mast bottom end (124), wherein the third mast channel (130*c*) comprises a channel opening (131), wherein a fourth linear mast channel (130*d*) is disposed in the mast side wall (126) from the mast top end (122) and extending toward the mast bottom end (124), wherein the fourth mast channel (130*d*) comprises a channel opening (131), (e) a second indexing base (141) having a base top surface (142) and a base bottom surface (144), wherein an attachment clip (150) is disposed on the base bottom surface (144) thereon, wherein the attachment clip (150) slidably attaches to the inner edge (112) of the panel (110) of the vehicle upon opening the panel (110), at an offset from the first indexing base (140), wherein an indexing mount (160) is disposed on the base top surface (142) thereon, wherein the indexing mount (160) adjustably attaches to the mast bottom end (124) via a fastener (170) disposed there through, wherein the indexing mount (160) allows the second mast (121) to pivot in at least a first direction and an opposing second direction with respect to the attachment clip (150), wherein the second mast (121) can be secured in a particular position via the fastener (170);

(f) a second pliable flag (181) having a proximal flag edge (182) and an opposing distal flag edge (184), wherein a second rigid mast attachment tab (190*b*) is disposed on the proximal flag edge (182), wherein the second mast attachment tab (190*b*) matedly slides through a mast channel aperture (138) disposed on the mast top end (122) into the third mast channel (130*c*); and (g) a pliable banner (210) having a first banner end (211) and an opposing second banner end (212), wherein a third rigid mast attachment tab (190*c*) is disposed on the first banner end (211), wherein the third mast attachment tab (190*c*) matedly slides through a mast channel aperture (138) disposed on the mast top end (122) into the second mast channel (130*b*) of the first mast (120), wherein a fourth rigid mast attachment tab (190*d*) is disposed on the second banner end (212), wherein the fourth mast attachment tab (190*d*) matedly slides through a mast channel aperture (138) disposed on the mast top end (122) into the fourth mast channel (130*d*) of the second mast (121).

* * * * *